US007481967B2

(12) United States Patent
Ukaji et al.

(10) Patent No.: US 7,481,967 B2
(45) Date of Patent: Jan. 27, 2009

(54) MOLTEN METAL TRANSPORTING CONTAINER

(75) Inventors: Bunji Ukaji, Nishio (JP); Kenji Ogawa, Yao (JP); Toshiyuki Matsumoto, Kasugai (JP); Tsunehiro Kato, Kasugai (JP); Kazuyoshi Uemoto, Kasugai (JP)

(73) Assignees: Nippon Crucible Co., Ltd., Tokyo (JP); Daiki Aluminum Industry Co., Ltd., Yao-shi, Osaka (JP)

( * ) Notice: Subject to any disclaimer, the term of this patent is extended or adjusted under 35 U.S.C. 154(b) by 271 days.

(21) Appl. No.: 10/584,111

(22) PCT Filed: Jul. 23, 2004

(86) PCT No.: PCT/JP2004/010900

§ 371 (c)(1),
(2), (4) Date: Jun. 23, 2006

(87) PCT Pub. No.: WO2005/061154

PCT Pub. Date: Jul. 7, 2005

(65) Prior Publication Data

US 2007/0152387 A1 Jul. 5, 2007
US 2008/0088069 A2 Apr. 17, 2008

(30) Foreign Application Priority Data

Dec. 24, 2003 (JP) ..... 2003-428094

(51) Int. Cl.
*C21C 5/42* (2006.01)

(52) U.S. Cl. ..... 266/274; 222/595

(58) Field of Classification Search ..... 266/274; 222/595

See application file for complete search history.

(56) References Cited

U.S. PATENT DOCUMENTS

| | | | | |
|---|---|---|---|---|
| 6,953,548 | B2 * | 10/2005 | Mancusi | 222/595 |
| 7,204,954 | B2 * | 4/2007 | Mizuno et al. | 222/595 |
| 2004/0070122 | A1 | 4/2004 | Mizuno et al. | |

FOREIGN PATENT DOCUMENTS

| | | | |
|---|---|---|---|
| EP | 1 304 184 | A1 | 4/2003 |
| JP | 02-052164 | A | 2/1990 |
| JP | 2002-254159 | A | 9/2002 |
| JP | 2002-307159 | A1 | 10/2002 |
| JP | 2003-225757 | A | 8/2003 |
| JP | 2003-225758 | | 8/2003 |
| JP | 2003-230954 | A | 8/2003 |
| JP | 2003-305561 | A1 | 10/2003 |
| JP | 2005-169446 | A | 6/2005 |

OTHER PUBLICATIONS

European Search Report by European Patent Office on Mar. 1, 2007.

* cited by examiner

*Primary Examiner*—Scott Kastler
(74) *Attorney, Agent, or Firm*—Knobbe Martens Olson & Bear LLP

(57) ABSTRACT

The present invention provides a molten metal transporting container having a long-reach-pouring spout connected to a pouring outlet of a pouring spout, and projects toward the outside of the container body, the molten metal transporting container further having a spout operating member for separating the long-reach-pouring spout from the pouring spout by raising the long-reach-pouring spout while it is projected from the container body, and a spout drawing member for drawing the long-reach-pouring spout that was separated from the pouring spout toward the container body.

5 Claims, 8 Drawing Sheets

MOLTEN METAL TRANSPORTING CONTAINER

TECHNICAL FIELD

The present invention relates to a molten metal transporting container that is used for supplying molten metal to a holding furnace at a casting site or for delivering molten aluminum from a manufacturer to a user.

BACKGROUND OF THE INVENTION

When conducting aluminum casting, etc., it is inefficient to remelt aluminum that was once molten by a manufacturer and solidified into an ingot. Therefore, molten aluminum is delivered to a casting site using a molten metal transporting container without changing the condition that was obtained by a smelter.

Furthermore, since the combined use of a centralized melting furnace and a small melting furnace increases equipment and labor costs, some manufacturers outsource the production of molten metal without installing a melting furnace in their factories, and conduct casting by being supplied with molten metal from outside using a molten metal transporting container.

Such a molten metal transporting container is provided with a long-reach-pouring spout to bring the pouring outlet near the molten metal surface in the holding furnace. This structure shortens the time for the molten metal to be in contact with air after it is taken out of the molten metal transporting container, and therefore reduces air oxidation of the molten metal. This calms the molten metal surface and reduces the generation of oxide. It is also possible to further reduce the oxidation of the molten metal by dipping a pouring outlet provided on top of the long-reach-pouring spout into the molten metal in the holding furnace.

However, long-reach-pouring spouts are obstructive when molten metal transporting containers are transported, and the number of ladles that can be loaded into the loading space of a truck, etc., may be limited due to the space occupied by the long-reach-pouring spout.

A structure that may prevent the above problem is one in which the long-reach-pouring spout is rotatably connected to the pouring spout by means of a pin and is rotated so as to fit to the container body when transported. This structure prevents the long-reach-pouring spout from becoming obstructive when transported, makes it possible to smoothly transport the molten metal transporting container inside a factory or on an ordinary road using a fork lift, a truck, etc., and prevents the number of ladles loaded into the loading space of a truck, etc., from being limited due to the long-reach-pouring spout.

However, because a hardened layer of molten metal adheres to the inner side of the connection between the pouring spout and the long-reach-pouring spout, if the long-reach-pouring spout is rotated with the hardened layer of molten metal adhered to the connecting portion when the molten metal is supplied, the hardened layer of molten metal will become clamped between the long-reach-pouring spout and the pouring spout. This damages the connecting portion or deforms the pin, causing defects in the connection.

An object of the present invention is to provide a molten metal transporting container in which a long-reach-pouring spout is pulled toward the container body after removing the hardened layer of molten metal adhered to the inner side of the connecting portion between the long-reach-pouring spout and the pouring spout.

DISCLOSURE OF THE INVENTION

In order to achieve the above object, the present invention provides a molten metal transporting container having a long-reach-pouring spout connected to a pouring outlet of a pouring spout and projects toward the outside of the container body, the molten metal transporting container further having a spout operating member for separating the long-reach-pouring spout from the pouring spout by raising the long-reach-pouring spout while it is projected from the container body, and a spout drawing member for drawing the long-reach-pouring spout that was separated from the pouring spout toward the container body.

It is preferable that the spout drawing member be provided with a rotation shaft for drawing the long-reach-pouring spout that was separated from the pouring spout toward the container body by rotating it.

It is preferable that the pouring spout be provided with a protrusion or concave portion for aligning the pouring spout with the long-reach-pouring spout, and that the long-reach-pouring spout be provided with a protrusion or concave portion that fits in the protrusion or concave portion of the pouring spout in such a manner that the distance between the pouring spout and the long-reach-pouring spout that was separated from the pouring spout is greater than the height of the protrusion.

It is also preferable that the rotation shaft be suspended from the long-reach-pouring spout, and that a hole to which the rotation shaft is loosely fit be provided in the pouring spout, wherein the molten metal transporting container further includes a spout operating member that separates the long-reach-pouring spout from the pouring spout by raising the rotation shaft, and connects the long-reach-pouring spout to the pouring spout by lowering the rotation shaft.

BEST MODE FOR CARRYING OUT THE INVENTION

Figure 1:
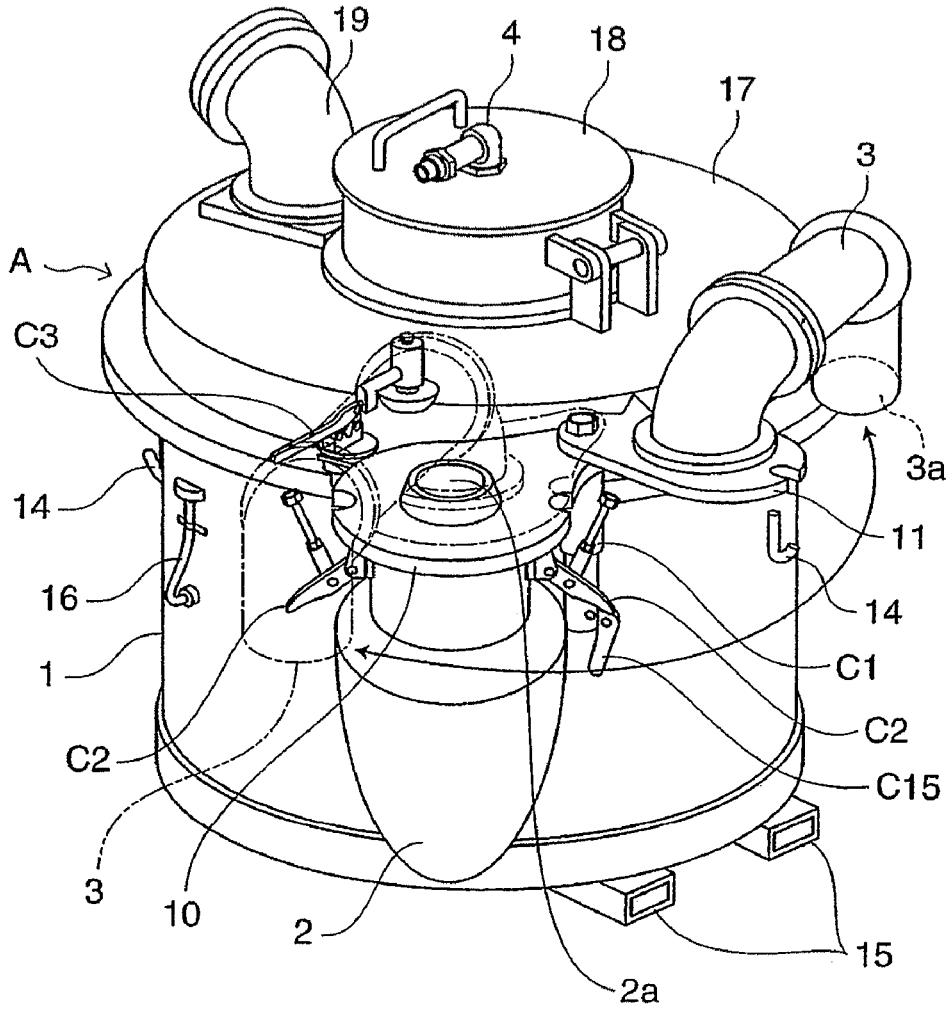
FIG. 1 is a perspective view showing an embodiment of the molten metal transporting container of the present invention.

Hereunder, an embodiment of the present invention is explained with reference to drawings.

A molten metal transporting container A is provided with a container body 1 for storing the molten metal, a pouring spout 2 having a pouring outlet 2*a* on top thereof, a long-reach-pouring spout 3 connected to the pouring outlet 2*a* and projecting toward the outside of the container body 1, a compressed air inlet port 4 for introducing compressed air into the container body 1, a locking device 5 for locking the long-reach-pouring spout 3 to the pouring spout 2, a spout operating member 6 for connecting the long-reach-pouring spout 3 to the pouring outlet 2*a* and separating it from the pouring spout 2, a spout drawing member 7 for drawing the long-reach-pouring spout 3 toward the container body 1 while the molten metal transporting container A is being transported, and an opening and closing means for the pouring outlet 8 provided with a pouring stopper C35 for covering the pouring outlet 2*a* while the molten metal transporting container A is being transported.

The container body 1 is formed by lining a shell case 1*a* with a thermal insulating material and a refractory layer 1*b* formed of a castable refractory material, wherein a molten metal inlet port 1*c* is formed in the base-end portion of the container body 1, a pouring spout 2 is connected to the molten metal inlet port 1*c*, and the pouring spout 2 protrudes upward while being slanted about 70° relative to a horizontal line.

The pouring spout 2 is formed by lining the inner side of the metal tube 2*a* with a refractory layer 2*b* and a refractory tubular molded element 2*c*. Use of the tubular molded element 2*c* improves the corrosion resistance of the pouring spout 2, making the lining process easier. The pouring outlet 2*a* of the pouring spout 2 is provided with a pouring spout nozzle 9 formed of cast iron, wherein a flange 10 is fixed to the pouring spout nozzle 9, and a groove 10*a* is formed in two locations on the periphery of the flange 10 disposed 180° apart from each other. The inner surface of the pouring spout nozzle 9 has a mortar-like shape in which the pouring stopper C35 of the opening and closing means for the pouring outlet 8 can fit in. This structure allows the pouring stopper C35 to fit in the pouring spout nozzle 9 and improves the sealing of the pouring outlet 2*a*, preventing the molten metal from leaking while being transported, etc. The pouring spout 2 is formed so as to have a straight linear axis, so that the entire inside of the pouring spout 2 can be visually checked from the pouring outlet 2*a*. This makes it possible to easily check the condition of the inner side of the pouring spout 2 such as aluminum ingot adhesion or damage to the refractory layer.

The long-reach-pouring spout 3 is formed by lining the metal tube 3*a* with a refractory layer 3*b* made of a calcium silicate refractory material. This refractory layer 3*b* improves the heat insulation property and abrasion resistance against the flowing of molten metal in the long-reach-pouring spout 3. A flange 11 is provided on the base-end portion of the long-reach-pouring spout 3, and a groove 11*a* is formed in two locations of the periphery of the flange 11 while remaining apart from each other by an interval of 180°. It is preferable that the top of the long-reach-pouring spout 3 be covered with a refractory material such as silicon nitride so that damage to the top of the long-reach-pouring spout 3 can be prevented when it touches the molten metal.

Figure 11:
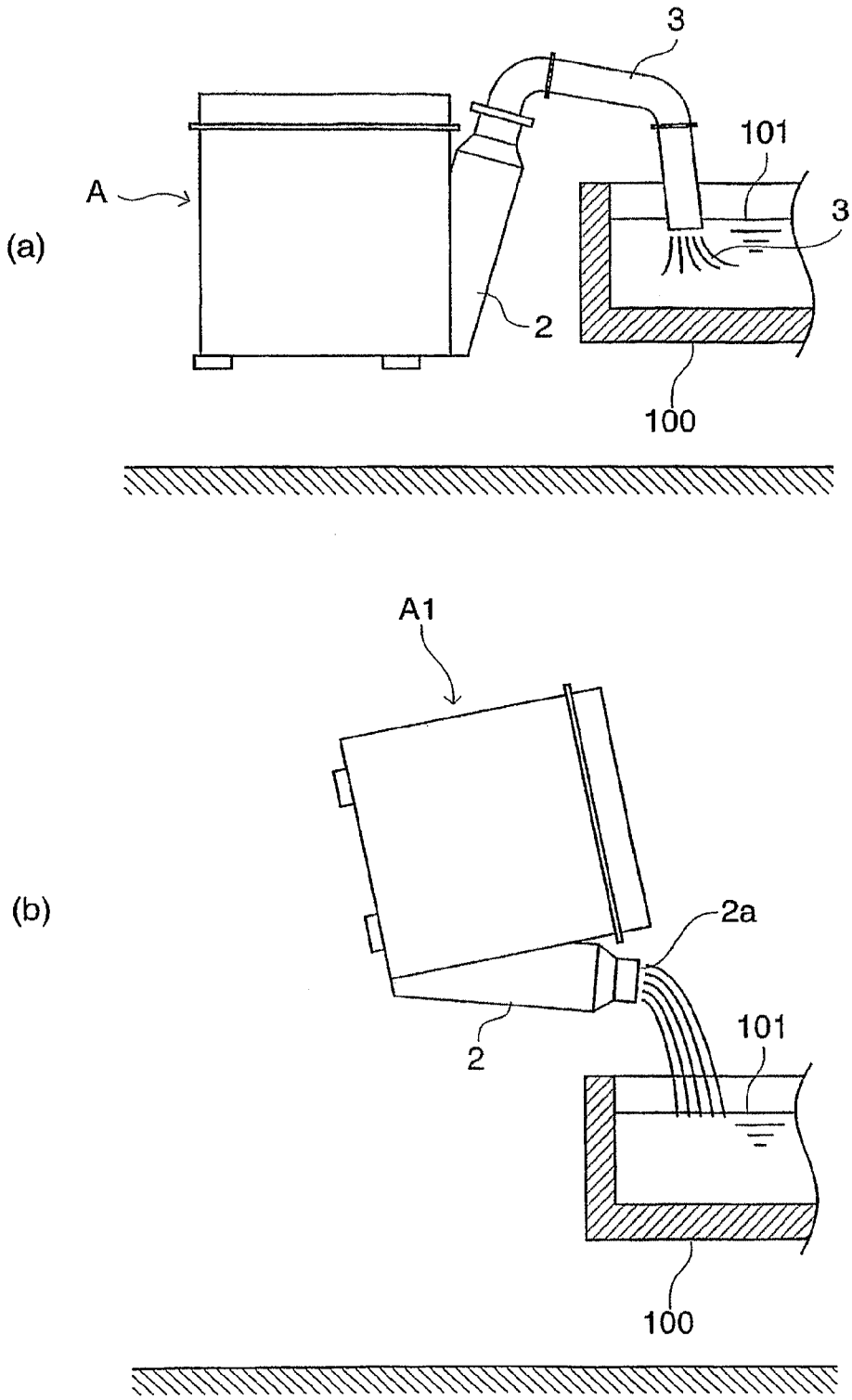
FIG. 11(*a*) is a side elevational view showing a molten metal supply operation according to the present embodiment, and FIG. 11(*b*) is a side elevational view showing a molten metal supply operation using a conventional molten metal transporting container.

The long-reach-pouring spout 3 is bent in two locations, so that the top of the long-reach-pouring spout 3 faces the surface of the molten metal in the holding furnace 100 to which additional molten metal is supplied without slanting the molten metal transporting container A. Therefore, the molten metal released from the pouring outlet 2*a* of the molten metal transporting container A by applying pressure as described later is directed to the outside of the container body 1 due to the long-reach-pouring spout 3, flowed downwardly and then poured into the holding furnace 100. This makes it possible to pour while locating the extension pouring outlet 3*a* below the molten metal surface 101 in the holding furnace 100 as shown in FIG. 11(*a*). As a result, oxidation of the molten metal released from the metal transporting container A is reduced by shortening the time that the metal is in contact with air, the surface of the molten metal is made still, and the generation of oxide is reduced compared to an inclined rotary-type molten metal transporting container A1 without a long-reach-pouring spout as shown in FIG. 11(*b*), by which molten metal is made to fall from the pouring outlet 2*a* of the pouring spout 2 onto the molten metal surface 101 in the holding furnace 100. By dipping the extension pouring outlet 3*a* into the molten metal in the holding furnace 100, the oxidation of the molten metal can be further reduced. It is also possible to reduce the oxidation of the molten metal by forming the long-reach-pouring spout 3 so that the extension pouring outlet 3*a* is located in the vicinity of the molten metal surface 101.

Figure 2:
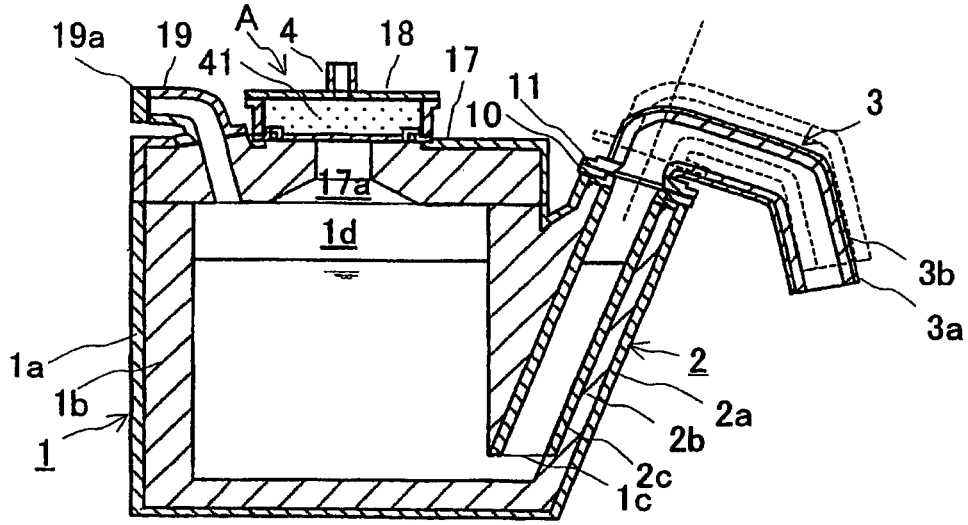
FIG. 2 is a front cross-sectional view of the molten metal transporting container of the present embodiment.

The spout drawing member 7 is provided with a rotation shaft 7*a*. The rotation shaft 7*a* is provided so as to be suspended from the flange 11 of the long-reach-pouring spout 3. The flange 10 of the pouring spout 2 is provided with a through-hole 10*b*, and a shaft guide cylinder 12 that communicably opens to the through-hole 10*b* is provided so as to be suspended from the flange 10. By inserting the rotation shaft 7*a* into the through-hole 10*b* and the shaft guide cylinder 12, it is possible to rotate the long-reach-pouring spout 3 around the rotation shaft 7*a* as shown by the arrow in FIG. 1, and bring the long-reach-pouring spout 3 so that it projects outward from the container body 1 near the container body 1 side, or draw the long-reach-pouring spout 3 toward the container body 1 to project outward from the container body 1. If the flanges 11 and 10 are arranged horizontally, the extension pouring tubing 3 can be rotated horizontally. If the flanges 11 and 10 are arranged at a slant as shown in FIG. 2, it is possible to rotate the long-reach-pouring spout 3 in an inclined manner and position it above the cover 17. In the present invention, the long-reach-pouring spout 3 is rotated after separating it from the pouring spout 2, and therefore the molten metal pouring spout 3 can be positioned above the cover 17 with a small slant, or without slanting the long-reach-pouring spout 3 at all.

Figure 12:
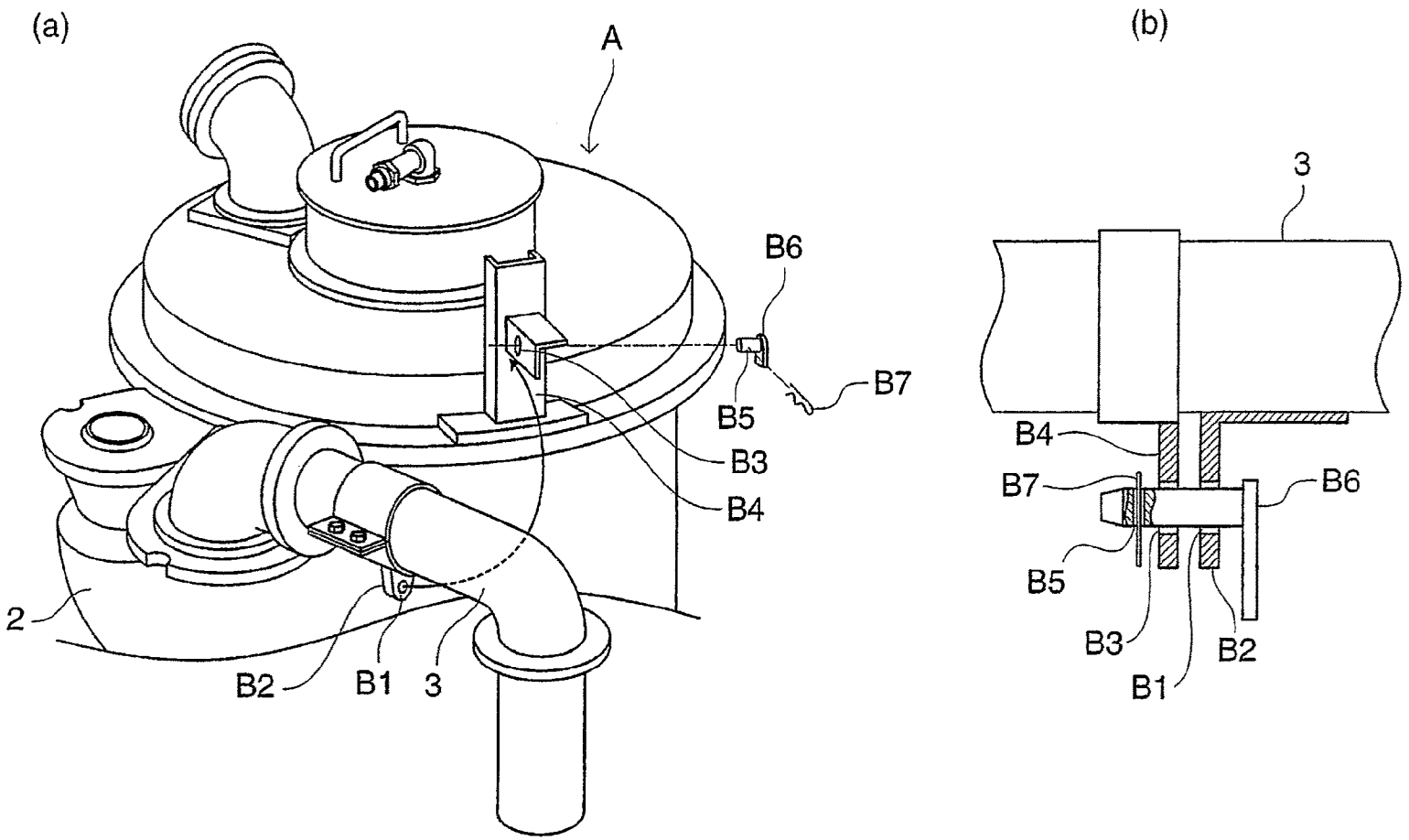
FIG. 12(*a*) is a perspective view showing a positioner for positioning the long-reach-pouring spout of the present embodiment, and FIG. 12(*b*) is a cross-sectional view showing the positioner.

FIG. 12 shows a means B for positioning the long-reach-pouring spout 3 in the position drawn toward the container body 1. The means B is provided with a mounting piece B2 having a hole B1 by which the means B is fixed to the long-reach-pouring spout 3; a mounting piece B4 having a hole B3 by which the means B is fixed to the container body 1, a fixing pin B6 having an anti-slip hole B5, and an anti-slip body B7 that prevents the fixing pin B6 from slipping off. The long-reach-pouring spout 3 is brought near the container body 1, the holes B1 and B3 of the mounting pieces B2 and B4 are aligned, the fixing pin B6 is inserted into the holes B1 and B3, and the anti-slip body B6 is inserted into the anti-slip hole B5 in the fixing pin B6, thus positioning the long-reach-pouring spout 3.

Figure 3:
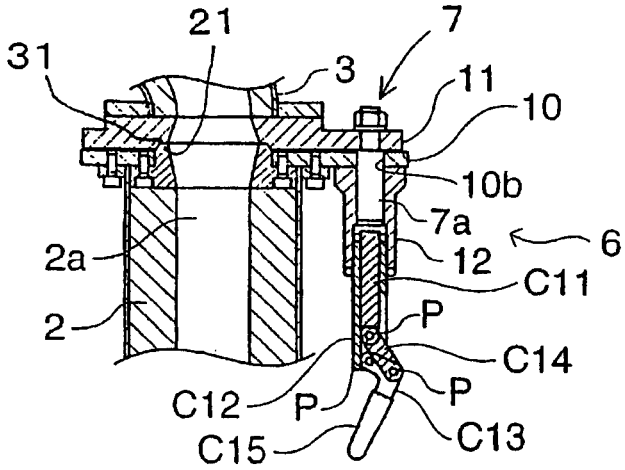
FIG. 3 is a cross-sectional view showing the operation of the long-reach-pouring spout of the present embodiment using a push-type toggle clamp.
Figure 4:
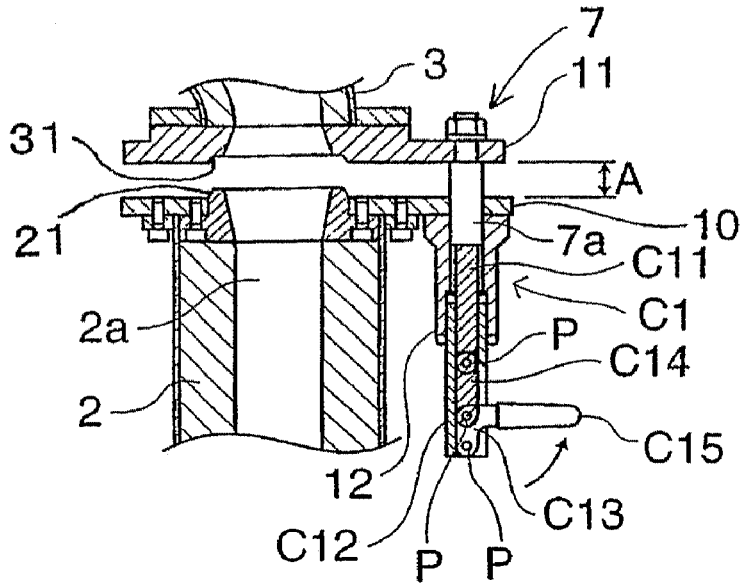
FIG. 4 is another cross-sectional view showing the operation of the long-reach-pouring spout of the present embodiment using a push-type toggle clamp.
Figure 5:
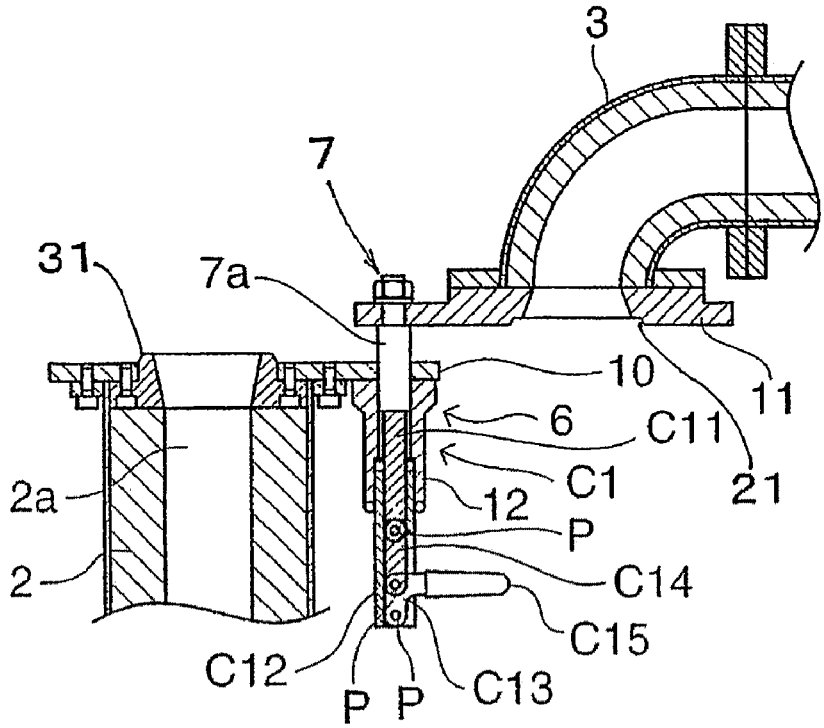
FIG. 5 is a cross-sectional view showing the operation of the long-reach-pouring spout of the present embodiment using a spout drawing member.

As shown in FIGS. 3 to 5, the spout operating member 6 of the long-reach-pouring spout 3 is provided with a push-type toggle clamp C1. The push-type toggle clamp C1 is provided with a rod C11 for moving the rotation shaft 7*a* of the long-reach-pouring spout 3 up and down, and a holding frame C12 formed in the shaft guide cylinder 12. The rod C11 is slidably held by the shaft guide cylinder and driven by a toggle mechanism C13. The toggle mechanism C13 is provided with a pair of links C13 and C14 that are rotatably attached to each other by a pin P, wherein the first link C13 is rotatably attached to the holding frame C12 and the second link C14 is rotatably attached to the rod C11 via pins P, and the rod C11 is moved up and down by sliding the links C13 and C14 using a manually slidable handle C15. The handle C15 is integrally formed with the first link C13.

By moving the handle C15 upward as shown in FIG. 4, the first link C13 slides upwardly wherein all of the pins are positioned on the same line and the rod C11 is located at the highest possible position. From this position, the rod C11 is slightly pushed by rotating the handle C15 upwardly. When the pin P located in the middle position is slightly rotated while the pin P at the lowest position in its center position, the links C13 and C14 contact the holding frame 7 so that the rotation of the links C13 and C14 is stopped. In this structure, the rotation shaft 7*a* of the long-reach-pouring spout 3 is pushed upward by the rod C11, and the long-reach-pouring spout 3 is separated from the pouring outlet 2*a* and raised to lift height A. This makes it possible to peel off the hardened layer of molten metal adhered to the inner surface of the connecting portion between the pouring spout 2 and the long-reach-pouring spout 3, and to remove the hardened layer of molten metal by inserting a scraper or the like between the pouring spout 2 and the long-reach-pouring spout 3.

In order to align the pouring spout 2 with the long-reach-pouring spout 3, a protrusion 21 is provided on the pouring spout 2 and a concave portion 31 that fits the protrusion 21 is provided in the long-reach-pouring spout 3. Therefore, the distance between the pouring spout 2 and the long-reach-pouring spout 3 that was separated from the pouring spout 2 is designed to be greater than the height of the protrusion 21.

In contrast, by moving the handle C15 downward as shown in FIG. 3, the first link C12 is made to slide downwardly to bring the rod C11 down. Thereafter, the molten metal pouring spout 3 is aligned with the pouring outlet 2*a* of the pouring spout 2, and the flange 11 of the long-reach-pouring spout 3 is laid on the flange 10 of the pouring spout 2.

Figure 6:
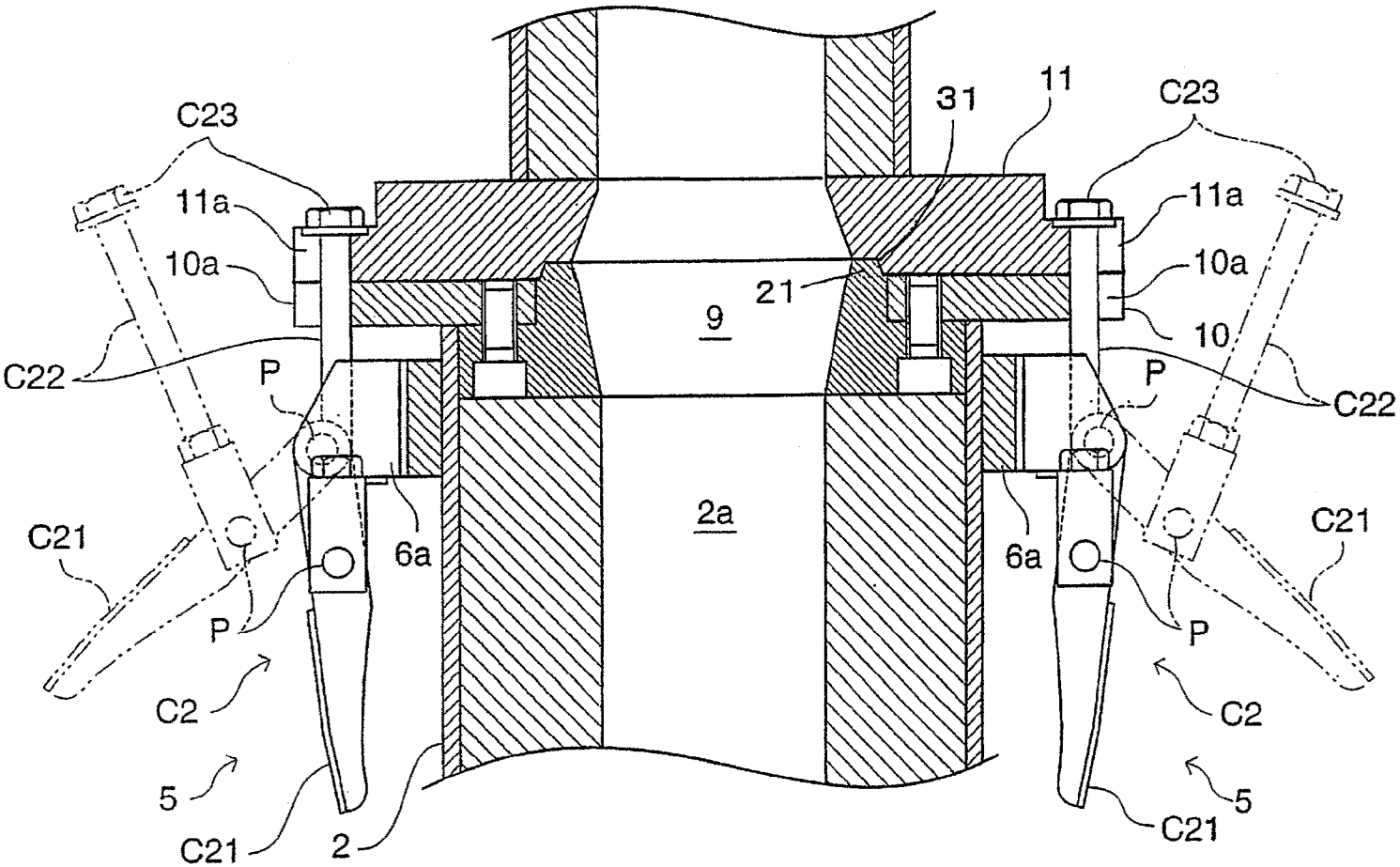
FIG. 6 is a cross-sectional view showing the operation of the locking device of the present embodiment.
Figure 7:
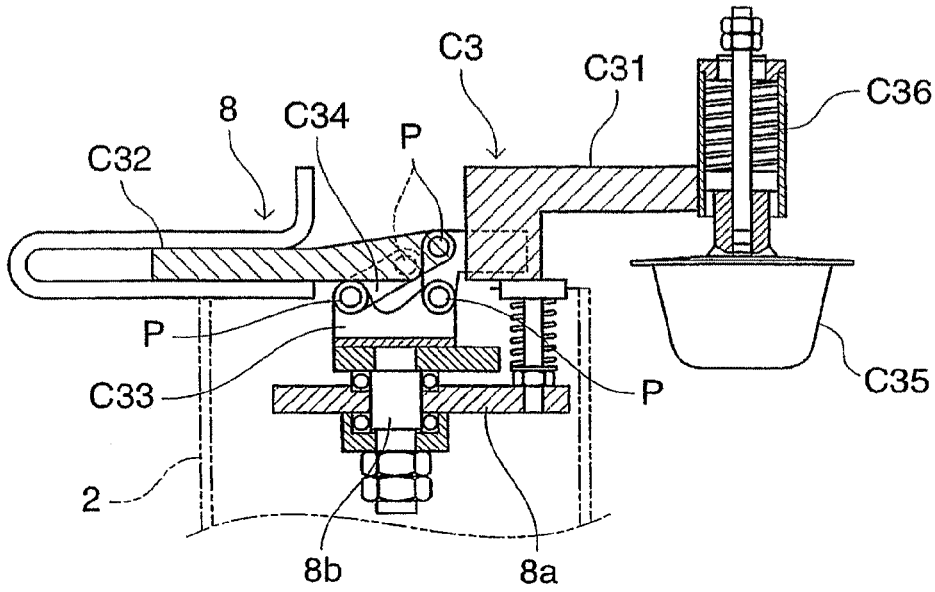
FIG. 7 is a cross-sectional view showing the operation of the opening and closing means for the pouring outlet of the present embodiment.
Figure 8:
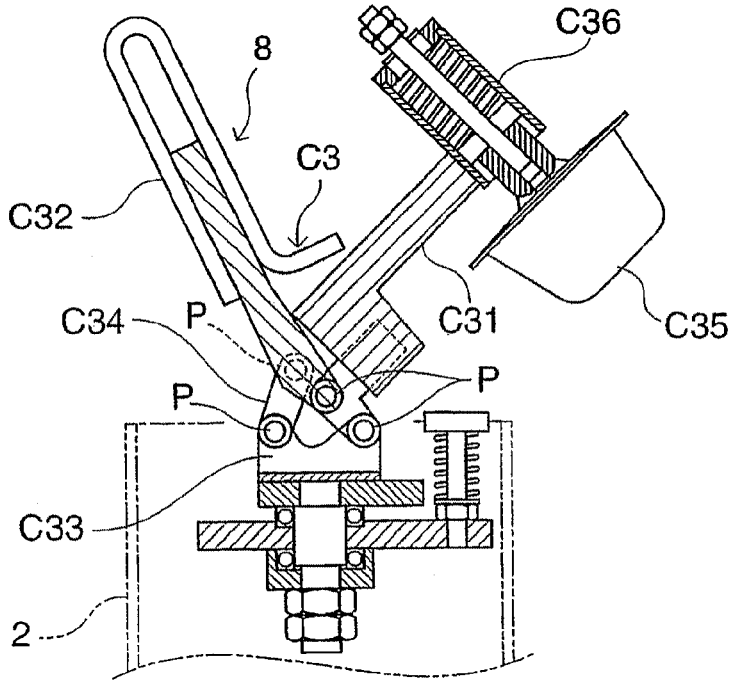
FIG. 8 is a cross-sectional view showing the operation of the opening and closing means for the pouring outlet of the present embodiment.

As shown in FIG. 6, the locking device 5 of the long-reach-pouring spout 3 is provided with a pulling-type toggle clamp C2, and the pulling-type toggle clamp C2 is attached to a bracket 6*a* formed outside the pouring spout 2. The pulling-type toggle clamp C2 is provided with a handle C21, wherein the base-end portion of the handle C21 is rotatably attached to the bracket 6*a* via a pin P, the base-end portion of the connecting link C22 is rotatably attached to the middle part of the handle C21 via a pin P, and a catching member C23 is provided on the top portion of the connecting link C22.

FIG. 6 shows the long-reach-pouring spout 3 locked to the pouring spout 2 by the pulling-type toggle clamp C2, wherein, as described above, the long-reach-pouring spout 3 is connected to the pouring outlet 2*a*, and the flange 11 is locked by being hooked by the catching member C23 with the flanges 10 and 11 placed one on top of the other. The long-reach-pouring spout 3 is thus locked to the pouring spout 2. In order to unlock the long-reach-pouring spout 3, as shown by the double-dashed chain line, the catching member C23 is pushed upward by moving the handle C15 upward. In order to relock the long-reach-pouring spout 3, the catching member C23 is brought down by moving the handle C15 down after placing the connecting link C22 in the groove 11*a* of the flange 11.

As shown in FIGS. 7 to 10, the opening and closing means for the pouring outlet 8 is provided with a toggle clamp C3, and the toggle clamp C3 is attached to the bracket 8*a* fixed to the pouring spout 2. The toggle clamp C3 is provided with a stopper arm C31, a handle C32, a support plate C33, and a link C34 for connecting the handle C32 to the support plate C33, wherein the support plate C33 is horizontally and rotatably attached to the bracket 8*a* via the rotation shaft 8*b*. A pouring stopper C35 for opening and closing the pouring outlet 2*a* is disposed on top of the stopper arm C31, and the pouring stopper C35 is energized by a spring C36. The bottom end of the stopper arm C31 is rotatably attached to one end of the support plate C33 via a pin P, the bottom end of the link C34 is rotatably attached to the other end of the support plate C33 via a pin P, and the rear end of the stopper arm C31 is connected to the top end of the handle C32 via a pin P. The top portion of the link C34 that is pivotably supported by the support plate 2 is rotatably attached in the vicinity of the handle C32 by a pine P.

Figure 9:
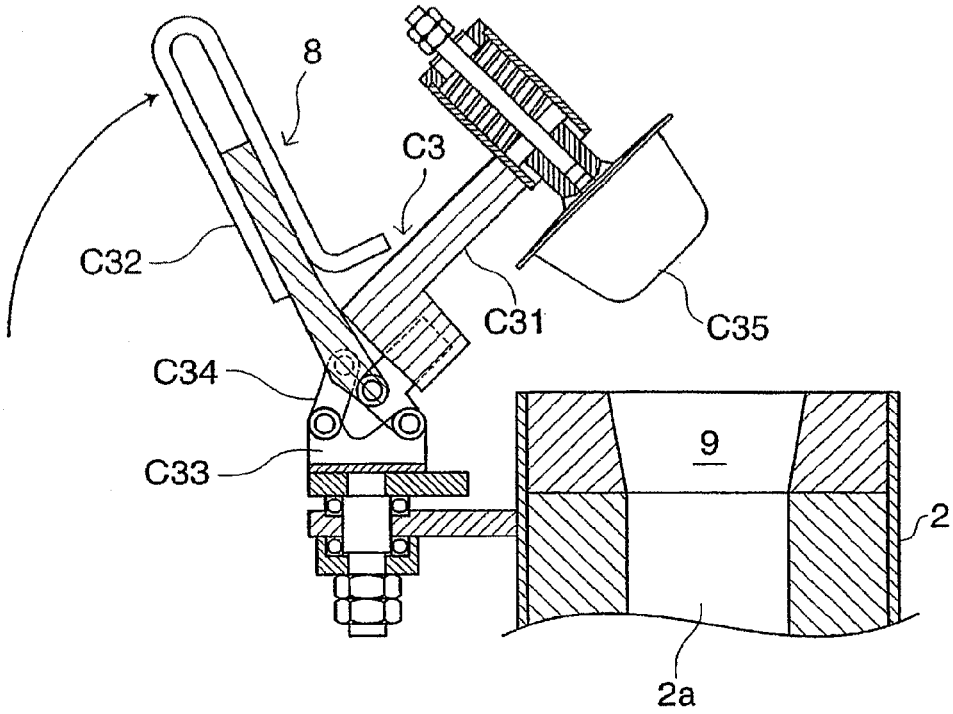
FIG. 9 is a cross-sectional view showing the operation of the opening and closing means for the pouring outlet of the present embodiment.
Figure 10:
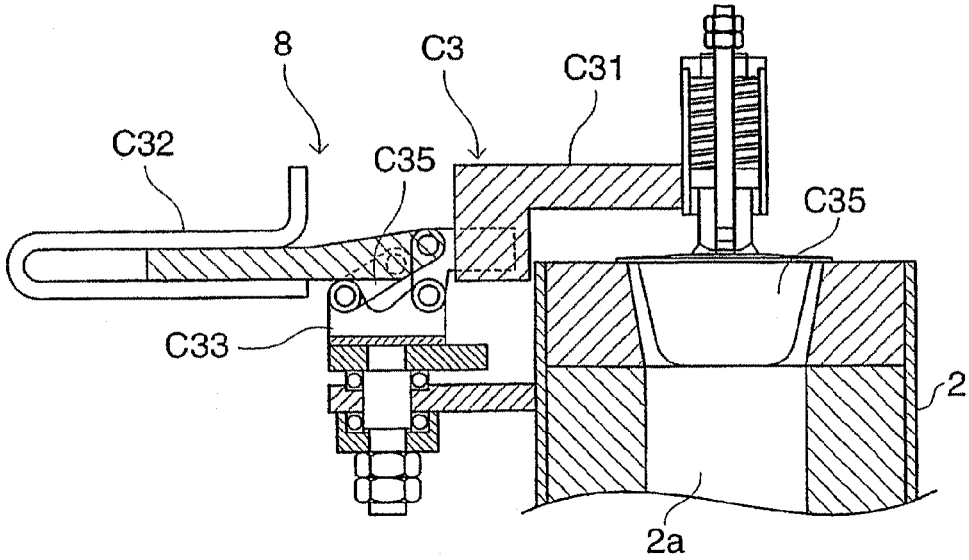
FIG. 10 is a cross-sectional view showing the operation of the opening and closing means for the pouring outlet of the present embodiment.

When the handle C32 is rotated upwardly as shown in FIG. 9, the link 7 and the stopper arm C31 slide and the stopper arm C31 is raised. In contrast, by rotating the handle downwardly as shown in FIG. 10, the stopper arm C31 is dropped down so that the pouring outlet 2*a* is covered by the pouring stopper C35. In this case, due to the elastic force of the spring C36, the engagement between the pouring stopper C35 and the pouring spout nozzle 9 in the pouring outlet 2*a* is enhanced. This prevents the reduction of engagement caused by the vibration received by the molten metal transporting container A while being transported.

When the stopper arm C31 is raised, the toggle clamp C3 is horizontally rotatable with the rotation shaft 8*b* as its center, and this allows the pouring stopper C35 to be separated from the pouring outlet 2*a*.

The structures of other components of the molten metal transporting container A are as follows: A stopper 14 is provided on the side wall of the container body 1 for locking the molten metal transporting container to the loading space of a truck while being transported, and a fork insertion member 15 is provided on the base-end portion of the container body 1. The molten metal transporting container A is transported in such a manner that the forks (not shown) of a fork lift are inserted into a fork insertion member 15, and a temperature sensor 16 for a refractory lining is provided on the side wall of the container body 1.

As shown in FIG. 2, an opening 1*d* is formed in the top of the container body 1, and a cover 17 is provided over the opening 1*d*. Furthermore, a small opening 17*a* is formed in the cover 17, and a small cover 18 is provided over the small opening 17*a*. Using a pressure means (not shown), such as a compressor, that is disposed outside the container, compressed air is supplied to the container through a porous member 41 of a compressed air inlet 4 provided on the small cover 18.

Numerical symbol 19 in the figure indicates a flue that is covered by the cover 19*a* during transport or pouring.

Pouring is conducted in the following manner using a molten metal transporting container A having the above-described structure:

When a molten metal transporting container A containing molten metal is transported, the long-reach-pouring spout 3 is positioned along the container body 1 by drawing it toward the container body 1 using the spout drawing member 7, so that it will not obstruct the transporting or other operations. The pouring outlet 2*a* is also covered by a pouring stopper C35.

The pouring preparation is as follows: First, the pouring stopper C35 is separated from the pouring outlet 2*a* by raising the handle using the opening and closing means for the pouring outlet 8, then the toggle clamp C3 is rotated around the rotation shaft 8*b* to retract the pouring stopper C35 from above the pouring outlet 2*a*. Subsequently, the long-reach-pouring spout 3 is rotated by the spout drawing member 7 so that the long-reach-pouring spout 3 projects outward from the container body 1. Thereafter, the long-reach-pouring spout 3 is brought down by the spout operating member 6, connected to the pouring outlet 2*a* in the pouring spout 2, and then locked to the pouring outlet 2*a* by the locking device 5.

Pouring into the holding furnace 100 is conducted in the following manner. The compressed air inlet port 4 is connected to a compressed-air supplier (compressor, not shown), and the container body 1 is pressurized by compressed air. As a result of the pressure of the compressed air, the molten metal is supplied from the pouring outlet 2*a* of the pouring spout 2 via the long-reach-pouring spout 3 to the holding furnace, etc. This structure allows the molten metal transporting container A to function as a pressurized pouring container by which molten metal can be supplied using the long-reach-pouring spout 3 projecting from the container body 1, and therefore pouring can be conducted without tilting the molten metal transporting container A as shown in FIG. 11(*b*).

After the pouring operation is completed, the long-reach-pouring spout 3 is unlocked, raised to the lift height A using the spout operating member 6, and pulled toward the container body 1 by the spout drawing member 7. Thereafter, the pouring outlet 2*a* is covered by the pouring stopper C35. The molten metal transporting container A is transported to the pouring site in this condition.

In the present embodiment, because the locking device 5, the spout operating member 6, and the opening and closing means for the pouring outlet 8 of the long-reach-pouring spout 3 are located in the vicinity of the pouring outlet 2*a*, and a toggle clamp is employed, the efficiency of the pouring operation is increased. Furthermore, these components may be small, and therefore they do not become obstacles even if they are attached to the outside of the container body 1 as protrusions. This makes the transfer of molten metal within a casting site, the delivery of molten metal using a vehicle, and the receipt and supply of molten metal smooth.

Note that the molten metal transporting container A in the present embodiment is a pressurized-type container; however, it is also possible to conduct pouring without applying pressure but by tilting the molten metal container.

EXAMPLE

A molten metal transporting container A having the structure described below was used. Because the molten metal could be poured without tilting the molten metal transporting container A, no special skills were necessary for pouring, and therefore the pouring operation was completed in an easy, quick, and safe manner. Compared to a conventional tilting-type pouring container, the container of the present invention had the following advantages: the molten metal supplied through the long-reach-pouring spout 3 calmed the surface of the molten metal in the holding furnace; and the generation of oxide was reduced because the molten metal was in contact with the air for a shortened time, improving the quality of the molten metal. Furthermore, since the long-reach-pouring spout 3 was drawn toward the container body and the protrusions were made smaller, it was possible to make the molten metal transporting container compact, simplify the transporting operation, increase the number of containers that could be loaded onto a truck, and significantly simplify the pouring operation.

The specifications of the container are as follows:

(1) Container capacity: 1000 kg of molten aluminum
(2) Pressurization: 0.03 MPa of compressed air
(3) Long-reach-pouring spout: bent at two locations, inside diameter of 80 mm, and total length of 850 mm
(4) Number of pouring cycles: six molten holding furnaces per metal transporting container 1
(5) Pulling-type toggle clamp for the long-reach-pouring spout:
FA-160, manufactured by Kakuta, Inc.
Stroke of 40 mm
Pulling force of 3 kN
(6) Push-type toggle clamp for the long-reach-pouring spout:
51MD, manufactured by Kakuta, Inc.
Stroke of 43 mm
Thrust of 3 kN
Lift height of 30 mm
(7) Toggle clamp for the pouring outlet opening—or closing means:
38D, manufactured by Kakuta, Inc.
Thrust of 5 KN As described above, the molten metal transporting container of the present invention is provided with a spout operating member for separating the long-reach-pouring spout from the container body by raising the long-reach-pouring spout while it is projected from the container body; and a spout drawing member that pulls the long-reach-pouring spout that was separated from the pouring spout toward the container body. Therefore, a force to separate the hardened layer of molten metal that adheres inside the portion connecting the long-reach-pouring spout with the pouring spout from inside the tube is applied by raising the long-reach-pouring spout, and the hardened layer of molten metal exposed between the pouring spout and the long-reach-pouring spout can be removed using a scraper, etc. This prevents an incomplete connection due to the connecting portion of the tube being damaged by the hardened layer of molten metal.

Furthermore, if the spout drawing member is provided with a rotation shaft for rotating the long-reach-pouring spout that was separated from the pouring spout to bring it near the container body, the long-reach-pouring spout can be easily brought near the container body by rotating the long-reach-pouring spout around the rotation shaft.

If a protrusion or concave portion for aligning the pouring spout with the long-reach-pouring spout is provided on the pouring spout and a protrusion or concave portion that fits the above-mentioned protrusion or concave portion is provided on the long-reach-pouring spout, and the distance of the long-reach-pouring spout that was separated from the pouring spout is made greater than the height of the protrusion, even if an alignment protrusion exists, the long-reach-pouring spout can be drawn without being disturbed by the projection.

If the container of the present invention has a rotation shaft that is suspended from the long-reach-pouring spout, wherein the rotation shaft is rotatably fitted in a hole in the pouring spout side, and a spout operating member is provided to separate the long-reach-pouring spout from the pouring spout by raising the rotation shaft and to connect the long-reach-pouring spout to the pouring spout by bringing the rotation shaft down, it is possible to separate the long-reach-pouring spout from the pouring spout, and connect it to the pouring spout, merely by raising the rotation shaft.

The invention claimed is:

1. A molten metal transporting container comprising:

a long-reach-pouring spout connected to a pouring outlet of a pouring spout and projects toward the outside of the container body, a spout operating member for separating the long-reach-pouring spout from the pouring spout by raising the long-reach-pouring spout while the long-reach-pouring spout is projected from the container body, and a spout drawing member for drawing the long-reach-pouring spout that was separated from the pouring spout toward the container body.

2. A molten metal transporting container according to claim 1, wherein the spout drawing member is provided with a rotation shaft for drawing the long-reach-pouring spout that was separated from the pouring spout toward the container body by rotating it.

3. A molten metal transporting container according to claim 2, wherein the pouring spout is provided with a protrusion or concave portion for aligning the pouring spout with the long-reach-pouring spout, and the long-reach-pouring spout is provided with a protrusion or concave portion that fits in the protrusion or concave portion of the pouring spout in such a manner that the distance between the pouring spout and the long-reach-pouring spout that was separated from the pouring spout is greater than the height of the protrusion.

4. A molten metal transporting container according to claim 2, wherein the rotation shaft is suspended from the long-reach-pouring spout, and a hole into which the rotation shaft can be loosely fit is provided in the pouring spout;

the molten metal transporting container further comprising a spout operating member that separates the long-reach-pouring spout from the pouring spout by raising the rotation shaft and connects the long-reach-pouring spout to the pouring spout by lowering the rotation shaft.

5. A molten metal transporting container according to claim 3, wherein the rotation shaft is suspended from the long-reach-pouring spout, and a hole into which the rotation shaft can be loosely fit is provided in the pouring spout;

the molten metal transporting container further comprising a spout operating member that separates the long-reach-pouring spout from the pouring spout by raising the rotation shaft and connects the long-reach-pouring spout to the pouring spout by lowering the rotation shaft.

* * * * *